United States Patent [19]

Rautenbach

[11] 4,195,111

[45] Mar. 25, 1980

[54] LOAD SUPPORTING MEANS AND THE FORMATION THEREOF

[75] Inventor: Jacobus J. Rautenbach, Muldersdrift, South Africa

[73] Assignee: Fowler Holdings Limited, Pretoria, South Africa

[21] Appl. No.: 845,422

[22] Filed: Oct. 25, 1977

[51] Int. Cl.[2] ..... B32B 7/02; E02D 27/00; E04B 2/00

[52] U.S. Cl. ..... 428/218; 52/169.13; 52/223 R; 52/423; 52/585; 52/725; 52/742; 428/220

[58] Field of Search ..... 428/220, 117, 178, 188, 428/218; 52/585, 173, 742, 169.13, 423, 594, 725, 223 R

[56] References Cited

U.S. PATENT DOCUMENTS

| | | | |
|---|---|---|---|
| 1,777,926 | 10/1930 | Lillard | 52/585 |
| 2,095,989 | 10/1937 | Lillard | 52/173 |
| 2,106,943 | 1/1938 | Fischer | 428/117 |
| 2,660,049 | 11/1953 | Maney et al. | 52/725 X |
| 3,095,943 | 7/1963 | Kemp | 428/117 X |
| 3,239,981 | 3/1966 | Fitzgerald | 428/220 X |
| 3,245,867 | 4/1966 | Clarke | 428/220 |
| 3,374,635 | 3/1968 | Crandall | 61/38 |
| 3,546,052 | 12/1970 | McNamara | 428/15 |
| 3,630,813 | 12/1971 | Allen | 428/117 X |
| 3,649,426 | 3/1972 | Gates | 428/117 X |
| 3,922,832 | 12/1975 | Dicker | 52/742 |
| 4,042,746 | 8/1977 | Hofer | 428/218 X |

*Primary Examiner*—Thomas J. Herbert, Jr.

[57] ABSTRACT

A displaceable load supporting cell for supporting a load. The cell comprises at least one compacted layer of particulate material compacted under a pressure of at least 800 kPa. The cell has a height less than its minimum lateral dimension. The cell includes retaining means for retaining the particulate material in the layer, and restraining means associated with the layer to restrain lateral displacement of the particulate material under load.

A method of forming the load supporting cell and a support pillar. The pillar comprises a stack of layers of particulate material compacted under a pressure of at least 800 kPa, and each layer having restraining means associated therewith to restrain lateral displacement of the particulate material under load, each layer having a height less than its minimum lateral dimension.

34 Claims, 10 Drawing Figures

LOAD SUPPORTING MEANS AND THE FORMATION THEREOF

This invention relates to load supporting means and the formation thereof. More particularly, this invention relates to a load supporting cell for use in supporting a load, a method of forming a load supporting cell, and a support pillar for supporting a load.

According to the invention there is provided a displaceable load supporting cell for supporting a load, and comprising at least one compacted layer of particulate material compacted under a pressure of at least about 800 kPa and having a height which is less than its minimum lateral dimension, retaining means for retaining the particulate material in the layer, and restraining means associated with the layer to restrain lateral displacement of the particulate material under load.

It will be appreciated that the degree of compaction of the particulate material into a compacted layer will influence the degree of compression of the load cell under an applied load during use.

Thus the compaction pressure applied to the particulate material will be related to the compression of the load cell which can be tolerated for the intended application of the load cell and for the loads intended to be supported by the load cell during use.

Therefore, if the degree of compression during use is to be reduced, the compacted layer may be a layer compacted under a higher or substantially higher pressure, as required, than the pressure of about 800 kPa.

In one embodiment of the invention, the compacted layer may be a layer compacted under a pressure of at least about 2,500 to 4,000 kPa.

In an alternative embodiment of the invention, the compacted layer may be a layer compacted under a pressure of between about 8,000 and about 25,000 kPa.

While the degree of compaction under an applied compaction pressure will depend upon the particulate material employed, for those types of particulate materials which can conveniently be employed, applicant has found that a compaction pressure in excess of about 25,000 kPa will usually tend to provide a relatively negligible further degree of compression resistance under an applied load.

It will be appreciated that the ratio of the height of the compacted layer to its minimum lateral dimension will influence not only the stability of the particulate material in the layer under an applied load, but also the lateral stability of the load cell during use.

Thus, in general, the smaller the ratio of the height of the layer to its minimum lateral dimension, the greater will be the lateral stability of the cell during use, the greater will be the resistance of the particulate material in the layer against lateral displacement under an applied load and the lesser will be the proportion of particles in the particulate material layer lying outside the limits of the angle of repose for that layer.

However, the smaller this ratio, the greater will be the cost to height ratio of the load cell in accordance with this invention.

In practice, therefore, the cost to height ratio of the load cell will be balanced against the lateral stability required during use of the load cell and the load supporting capacity required for the load cell during use to obtain the most practical height to minimum lateral dimension ratio.

In one embodiment of the invention, the ratio of the height of the layer to its minimum lateral dimension may be less than about 1:3.

In an alternative embodiment of the invention, the ratio of the height of the layer to its minimum lateral dimension may be between about 1:5 and about 1:10.

In a further alternative embodiment of the invention, where substantial lateral stability is required and where substantial loads are to be supported by the load cell, the ratio of the height of the layer to its minimum lateral dimension may, for example, be between about 1:15 and about 1:40, or less if required.

The particulate material may be any suitable particulate material which can be compacted under an applied compaction pressure to resist lateral displacement of the particulate material under an applied load.

It will be appreciated that, in general, the finer the particulate material, the greater will be its compaction under an applied compaction pressure, and the greater will its resistance tend to be to lateral displacement under an applied load.

The specific particulate material employed and the degree of finess of the particulate material would depend largely upon availability, ease of handling, and the intended load supporting capacity of the load cell of this invention.

The particulate material may therefore, for example, be in the form of sand, fine sand, mine sand, ground, powdered stone, and the like, or a mixture of one or more of these materials.

In an embodiment of the invention, the restraining means may comprise at least one restraining sheet or panel associated with the layer to extend transversely to the height of the layer.

In use, when a load is applied to the cell, the particulate material bears against the restraining panel so that lateral movement of the particulate material will tend to stretch the restraining panel.

Thus the restraint which the restraining panel provides against lateral displacement of the particulate materail will be related to the tensile strength of the restraining panel.

The choice of materials, composition and thickness of the restraining panel will thus depend upon the load to be supported by the cell and the degree of stretching within the elastic limits of the panel, which can be tolerated during use.

In general, the greater the tensile strength of the restraining panel, the greater will be the cost thereof. In practice, therefore, the cost can be balanced against the degree of stretch which can be tolerated in selecting an appropriate restraining panel for the loads to be supported by the cell during use.

The restraining panel may therefore be of sheet material, of composite sheet material, of reinforced sheet material, in the form of a mesh, or the like.

It will be appreciated that the same or similar tensile strength of a single restraining panel having a particular thickness, can be provided by using a plurality of similar panels having a lesser thickness. Thus the restraining panel may comprise a plurality of panels which are secured to each other, are located on top of each other, or are provided at spaced intervals throughout the compacted layer of particulate material. Where a plurality of panels are used, they may all have the same tensile strength, or may have varying tensile strength and may be arranged as required.

In the same way, a restraining panel can be reinforced throughout its area, or reinforced in selected zones only, such as its central zone for example.

The restraining panel may thus, for example, be of metal, a metal alloy, a synthetic plastics material, a reinforced natural or synthetic material, a woven or braided material, or the like.

In an embodiment of the invention, the restraining panel may be of mild steel sheet. In this embodiment, the mild steel sheet may conveniently be a hot or cold rolled mild steel sheet.

In an alternative embodiment of the invention, the restraining means may comprise a plurality of concentric, radially spaced, restraining bands embedded in the layer.

In this embodiment of the invention, the restraining bands may coveniently have a depth which is at least about one third of the height of the compacted layer. In an embodiment of the invention, the restraining bands may conveniently have a depth which is at least about two thirds of the height of the compacted layer or, if desired, which is substantially equal to the height of the compacted layer.

Where the restraining means is in the form of restraining bands, the resistance to lateral displacement of the particulate material will tend to depend upon the tensile strength of the bands, and the spacing between adjacent bands.

In an alternative embodiment of the invention, the restraining means may comprise a restraining spiral band embedded in the layer.

The depth of the spiral band in relation to the height of the compacted layer can vary in the same way as discussed with reference to the concentric restraining bands.

Whether the restraining means is in the form of concentric restraining bands or in the form of a spiral band, this restraining means may, if desired, be used in conjunction with a restraining panel as discussed above.

The degree of resistance afforded by the spiral band to lateral displacement of the particulate material under load will depend upon the number of successive loops of the spiral band as well as the tensile strength and/or resistance to deformation of the material constituting the spiral band.

Without wishing to be bound by theory, applicant believes that the spiral band combats lateral displacement of the particulate material under an applied load, since an outward lateral force on any part of the spiral band, will encounter resistance from an opposed inward force provided by the compressed particulate material on the opposed side of that part.

In addition, outward displacement of any part of the spiral band will, unless that part stretches, lead to longitudinal movement of some part of the spiral band and lateral movement of some other portion of the spiral band.

Applicant believes that any such longitudinal movement will tend to be combatted by frictional engagement between the particulate material and the spiral band, and that any such lateral movement will be combatted by the load bearing particulate material bearing against such portion.

Thus the spiral band can be designed for the load to be supported by the load cell, within practicable limits, by adjusting the number of the loops of the spiral band and be ensuring that the material of the spiral band has a sufficient tensile strength to combat undue stretching and/or deformation.

The concentric bands or spiral band, as the case may be, may therefore be of any of the suitable materials of which the restraining panel may be formed.

In an embodiment of the invention, they can conveniently be of a suitable metal alloy, or of a metal such as mild steel or the like.

The main purpose of the retaining means is to retain the particulate material in the layer during handling of the cell. The retaining means may therefore be any suitable type of retaining means which can achieve this purpose.

In one embodiment of the invention, the retaining means may comprise a retaining sleeve within which the layer is located.

In this embodiment of the invention, the retaining sleeve may be of any suitable material. Thus, for example, it may be of a synthetic plastics material, of a woven or braided material, of a metal alloy or metal, or the like.

Conveniently, the retaining sleeve may be of sheet metal, such as mild steel sheet.

Where the retaining means comprises a retaining sleeve and the restraining means comprises a restraining panel, the restraining panel may conveniently constitute an end wall of the cell and may be secured to or constitute an integral part of the retaining sleeve.

Where the retaining means comprises a retaining sleeve and the restraining means comprises a restraining spiral band, the outermost loop of the spiral band may conveniently be secured to or form an integral part of the retaining sleeve.

Where the retaining means comprises a retaining sleeve as described, and one or both opposed ends of the particulate material layer are exposed, additional retaining means may be provided at the exposed end or ends.

Such additional retaining means may be provided by a covering panel or sheet of any suitable sheet material, by an adhesive coating applied to the exposed surface of the compacted layer, or by a bonding agent incorporated in the particulate material in at least the surface layer of the particulate material.

In an alternative embodiment of the invention, the retaining means may comprise a bonding agent mixed with the particulate material and bonding the particulate material together under the compaction pressure.

Any suitable bonding agent may be employed, which is capable of bonding the particulate material together sufficiently to retain the particulate material in position during handling of the cell.

In one embodiment of the invention, the bonding agent may comprise a suitable bituminous compound solution.

In this embodiment of the invention, the bituminous compound solution may conveniently comprise such a solution known as a slurry sealed bituminous compound solution which comprises minute particles of bituminous compound suspended in water.

In this embodiment of the invention, once the particulate material has been compacted, the bituminous compound will tend to retain the particles in position during handling and, in addition, will tend to increase the resistance to lateral displacement of the particles during use.

Where a slurry sealed bituminous compound solution is employed comprising about 60% by volume of bituminous compound and about 40% by volume of water, the proportion by volume of bonding agent to particulate material may conveniently be between about 5% and about 20%. In a specific example, the proportion by volume may be between about 7% and about 10%.

In an alternative embodiment of the invention, the bonding agent may be in the form of a cementitious material or in the form of a suitable adhesive.

In one example of this embodiment, the adhesive may be in the form of a cold setting adhesive of any of the suitable types which are available. In one example of this embodiment, the cold setting adhesive may be in the form of a polyvinyl acetate based adhesive. Thus, for example, the adhesive may be in the form of a modified synthetic resin dispersion with a polyvinyl acetate base.

Typical adhesives of this type which are currently available, are the adhesive available under the trade marks "PONAL" and "ALCOLIN".

The proportion of volume of cold setting adhesive to particulate material may conveniently be between about 2% and about 10%.

In an embodiment of the invention, the proportion by volume of cold setting adhesive may be between about 2% and about 5%.

While greater proportions of bonding agent can be employed, this will lead to an increase in cost without any significant increase in the retaining properties required. In addition, if an excess of bonding agent is included, it can have the effect of causing the particulate material to become fluent thereby reducing the resistance to lateral displacement of the compact particulate material.

The particulate material may conveniently include moisture to improve compaction thereof.

While the preferred moisture content will vary depending upon the particular type of particulate material employed, for fine sand and mine sand, the moisture content may conveniently, for example, be between about 3% and about 8% by volume.

The cell of this invention may include a plurality of stacked, compacted layers of particulate material, with each layer having restraining means associated therewith.

The layers may be discrete layers by being separately compacted where the particulate material includes a suitable bonding agent, and then being associated with each other, or by having the restraining means in the form of restraining panels which are positioned between adjacent layers.

In this latter embodiment, each layer with its associated restraining panel may be compacted separately and the separate layers may then be associated with each other. Alternatively, the restraining panels may be positioned at intervals in the particulate material, and the particulate material may thereafter be compacted.

In this embodiment of the invention, the resistance to compression provided by the cell, and the load which can be supported by the cell, can be varied by varying the heights of the various layers, and thus the number of layers in a cell, and by varying the form and type of the restraining means employed.

The cell may include suspension tab means for use in suspending the cell during handling thereof.

The suspension tab means may conveniently have a shank portion which is embedded in the particulate material and/or secured to the restraining means prior to compaction of the particulate material.

The cell of this invention may have any suitable shape to facilitate use and handling thereof.

Thus, for example, the cell may be cylindrical, substantially cylindrical, tapered or partially tapered, and of or substantially of circular, polygonal, triangular, annular or the like cross-section.

Where the cell is or is substantially of triangular cross-section, a plurality of cells can be arranged in nesting relationship at the same horizontal level to increase the load carrying capacity and the resistance to compression.

Where the cell is or is substantially of annular cross-section, the lateral stability of the cell will be improved. Since the cell will thus have a hollow or substantially hollow core, the lateral stability will be improved without increasing the cost or mass of the cell unduly.

The cell of this invention may be made in any desired size. Conveniently, however, where ease of handling of the cell is a requirement, the size of the cell may be such that it has a mass permitting ready handling.

The cell of this invention may be provided with mating formations to allow corresponding cells to be mated with each other when arranged in a stacked relationship. Conveniently, complementary mating formations may be provided at the opposed ends of the cell.

Further according to the invention, there is provided a support pillar for supporting a load, and comprising a plurality of load supporting cells as described herein, stacked upon each other.

Further according to the invention, there is provided a support pillar for supporting a load, and comprising a stack of layers of particulate material compacted under a pressure of at least about 800 kPa, each layer having restraining means associated therewith to restrain lateral displacement of the particulate material under load, and each layer having a height less than its minimum lateral dimension.

The restraining means associated with each layer, may be in the form of any type of restraining means as hereinbefore described.

Where the restraining means includes restraining panels, the restraining panels may be such and may be positioned to separate adjacent layers from each other.

Where the restraining means comprises a restraining spiral band or the like, the layers may be separated from each other by restraining panels provided between adjacent layers, or by the particulate material incorporating a suitable bonding agent and the layers being compacted separately.

The layers may conveniently be compacted under a pressure greater than about 800 kPa. Thus, for example, the layers may be compacted under a pressure of between about 4,000 and about 16,000 kPa.

The same considerations would tend to apply to the ratios of the heights of the various layers to their minimum lateral dimensions as hereinbefore described.

Thus, for example, the ratio of the height of each layer to its minimum lateral dimension may be between about 1:3 and about 1:10, and conveniently between about 1:10 and about 1:20.

It will readily be appreciated that as the height of the pillar is increased, the mininum lateral dimension of the pillar will have to be increased to ensure lateral stability of the pillar during formation thereof and under load.

The support pillar of this invention may be used wherever a load is required to be supported.

The support pillar of this invention can therefore, for example, have particular application as a mine prop to support the hanging wall in mines since it can be designed to support substantial loads and provide tolerable degrees of compression.

Further in accordance with the invention, a method of forming a load supporting cell for supporting a load, includes the steps of filling a pan having a height less than its minimum lateral dimension and comprising a base panel and a retaining sleeve extending upwardly from the periphery of the base panel, with a particulate material, providing retaining means for retaining the particulate material when compacted in the pan, and applying a pressure of at least about 800 kPa to the particulate material to compact it into a layer in the pan.

In an embodiment of the invention, the retaining means may be provided by a bonding agent of any suitable type as hereinbefore described, mixed with the particulate material prior to compaction.

In an alternative embodiment of the invention, the retaining means may be provided by locating a cover panel on the particulate material prior to compaction, and by securing the cover panel to the retaining sleeve after compaction.

In an alternative embodiment of the invention, in place of a cover panel, an inverted pan may be located on the particulate material prior to compaction.

In this embodiment, the arrangement may be such that during compaction, the retaining sleeve and the depending skirt of the inverted pan will overlap so that they can be secured to each other during or after compaction.

Thus, for example, compaction may be effected in a suitable mould having an annular groove or an annular rib to allow deformation or cause deformation of the skirt and the sleeve in the overlapping zone thereby providing a firm connection between them.

The method may include the step of locating restraining means in the pan to restrain lateral displacement of the particulate material under load. In this regard, it will be appreciated that the base panel of the pan will in itself constitute a restraining panel as hereinbefore described.

The restraining means may be in the form of a restraining panel, a restraining spiral band, or the like which is embedded in the particulate material.

Conveniently, in carrying out the method, a compaction pressure of between about 2,500 and about 8,000 kPa may be applied.

In an alternative example of the invention, a compaction pressure of between about 8,000 and about 25,000 kPa may be applied.

The ratio of the height of the pan to its minimum lateral dimension may be less than about 1:3 and conveniently less than about 1:5.

In a specific example of the invention, the ratio may be between about 1:6 and about 1:15.

The method may include the step of moistening the particulate material to improve compaction thereof.

In an embodiment of the invention, a load supporting cell may be formed by using pans each comprising a base plate and a retaining sleeve extending upwardly from the periphery of the base plate, with the retaining sleeve diverging slightly as it moves away from the base plate.

In this embodiment, the pans may be filled with particulate material up to a required level. Thereafter, a desired number of filled pans may be stacked on top of each other. Since the retaining sleeves diverge, the pans will nest in each other.

Thereafter, a cover plate or an inverted cover pan comprising a base panel and a depending skirt may be placed on top of the stack.

The whole unit may then be located in a suitable mould having annular ridges at axially spaced intervals, and the unit may then be subjected to a sufficient pressure to compact the particulate material in the various pans.

During such compaction, the retaining sleeve of each pan will overlap portion of the retaining sleeve of the pan stacked thereon, whereas the skirt of the inverted pan will overlap with portion of the retaining sleeve of the uppermost pan.

With the annular ridges of the mould suitably positioned, they can deform the retaining sleeves and depending skirt in the overlapping zones to secure them together into a unitary cell.

This method provides a simple and effective method of forming a cell in accordance with this invention.

The invention futher extends to a cell whenever formed by the method as described herein.

Embodiments of the invention are now described by way of example with reference to the accompanying drawings.

Figure 1:
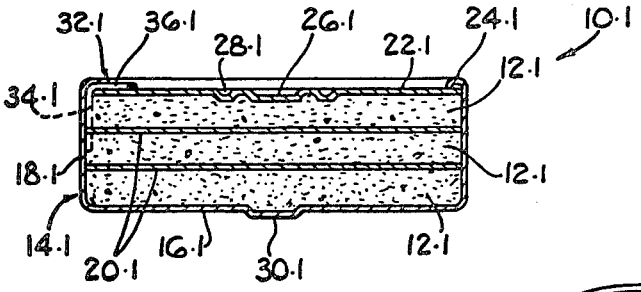
FIG. 1 shows a sectional side elevation along line I—I of FIG. 2, of one embodiment of a displaceable load supporting cell for supporting a load.
Figure 9:
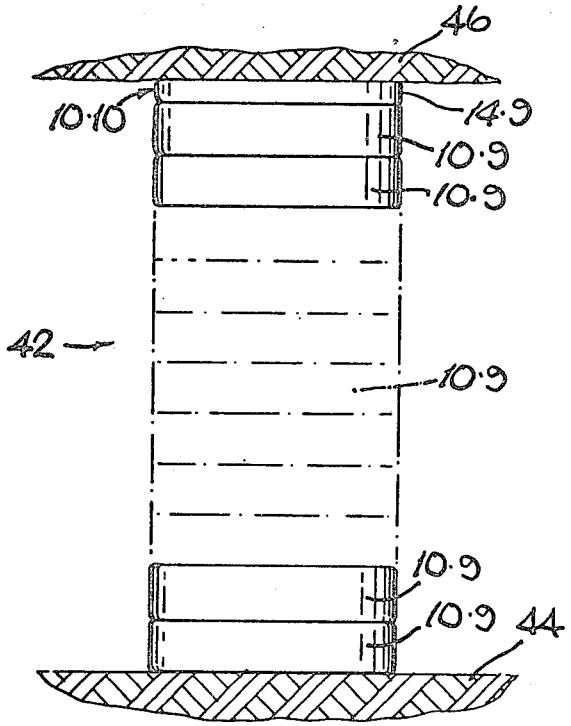
Figure 10:
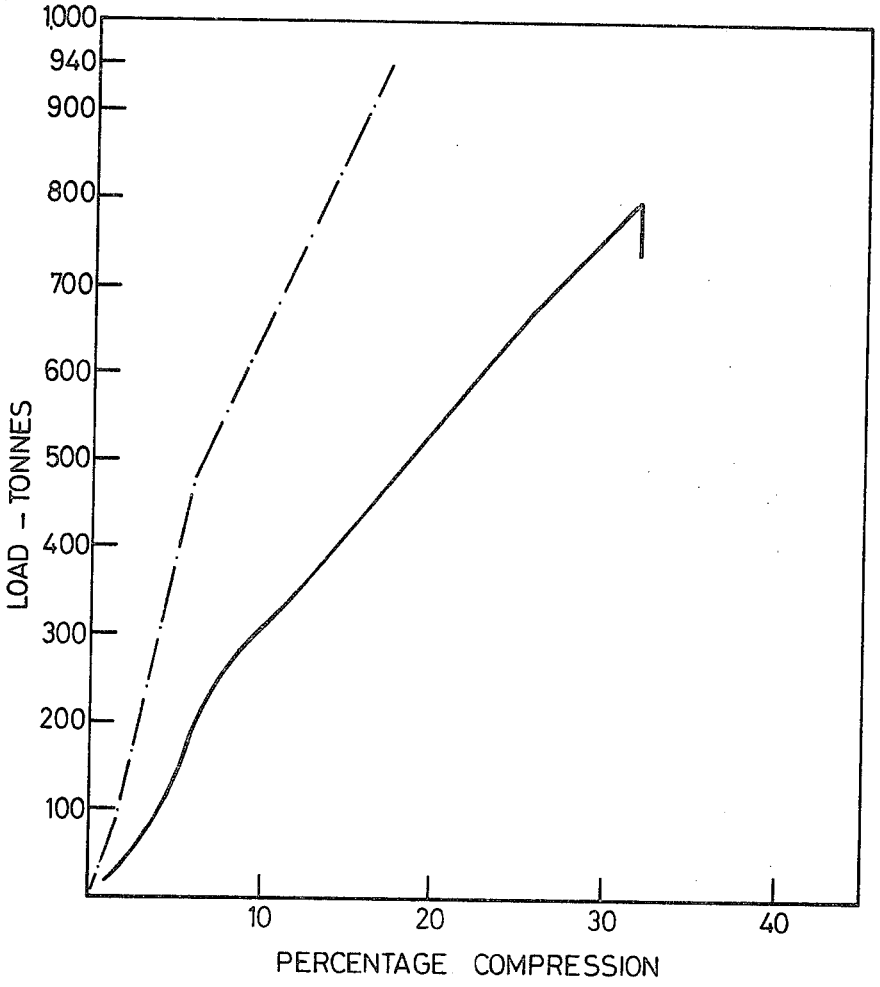

FIG. 9 shows a side view of a support pillar in the form of a mine prop formed by stacking a plurality of cells corresponding to those illustrated in FIG. 1 of the drawings; and FIG. 10 is a graph showing the load bearing capacity and compression of two support pillars formed out of two different types of loading supporting cells in accordance with this invention, with the applied load in tons plotted against the percentage compression.

Figure 2:
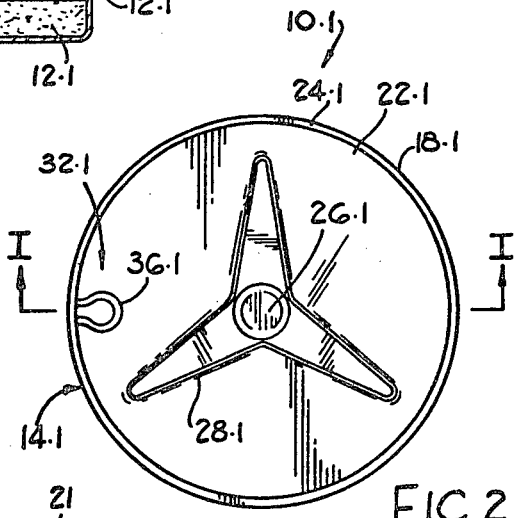
FIG. 2 shows a plan view of the cell of FIG. 1.

With references to FIGS. 1 and 2 of the drawings, reference numeral 10.1 refers generally to a displaceable load supporting cell for supporting a load.

The cell 10.1 comprises three stacked, compacted, discrete layers 12.1 of particulate material in the form of mine sand, contained within a pan 14.1.

The pan 14.1 comprises a base panel 16.1 and a retaining sleeve 18.1 extending upwardly from the periphery of the base panel 16.1.

The pan 14.1 is formed out of 22 gauge mild steel sheet in a pressing operation, so that the base panel 16.1 and retaining sleeve 18.1 are integral.

The cell 10.1 further comprises restraining means in the form of two restraining panels 20.1 which are positioned between the compacted layers 12.1 to restrain lateral displacement of the mine sand in the compacted layers 12.1 under a load supported by the cell 10.1.

The base panel 16.1 acts in the same way as the restraining panels 20.1 and therefore, together with the restraining panels 20.1, constitutes restraining means for the cell 10.1.

The cell 10.1 further includes retaining means for retaining the mine sand in position in the layers 12.1 during handling of the cell 10.1. The retaining means is partly provided by the retaining sleeve 18.1, and partly by a retaining cover panel 22.1 which is fixed to the retaining sleeve 18.1.

The retaining cover panel 22.1 and the restraining panels 20.1 are formed out of 26 gauge mild steel sheet.

For forming the cell 10.1, a first layer of mine sand is spread evenly in the pan 14.1, whereafter a restraining panel 20.1 is placed on top of the layer. Thereafter a further layer of mine sand is spread evenly on the restraining panel, and a further restraining panel 20.1 is located on that layer. Thereafter a final layer of mine sand is spread evenly on the uppermost restraining panel 20.1, and the restraining cover panel 22.1 is placed on that layer.

Thereafter a compaction pressure of 12,000 kPa is applied to the retaining cover panel 22.1 to compact the mine sand in the pan 14.1 into the three compacted layers 12.1.

After compaction, the free edges 24.1 of the retaining sleeve 18.1 are peened over onto the retaining cover panel 22.1 to locate it firmly in position.

Compaction of the mine sand is conveniently effected in a suitable press, with the pressure head of the press suitably shaped to form a mating socket formation 26.1 in the retaining cover panel 22.1, and to form grooves 28.1 in the retaining cover panel 22.1.

The grooves 28.1 serve to reinforce the retaining cover panel 22.1. They further serve the purpose of restraining lateral movement of the mine sand in the uppermost layer 12.1 during rough handling of the cell 10.1.

During formation of the pans 14.1, a mating spigot formation 30.1 was formed in the base panel 16.1.

The mating spigot formation 30.1 is complementary to the mating socket formation 26.1 thereby facilitating stacking of corresponding load supporting cells 10.1 to form a support pillar.

While the grooves 28.1 have been shown arranged in a substantially triangular configuration, it will be appreciated that the grooves can be arranged in any desired configuration. Thus, for example, they may be arranged in a clover leaf configuration, in the form of a star configuration, or the like.

During formation of the cell 10.1, a suspension tab 32.1 comprising a shank portion 34.1 and an eye portion 36.1 is located in position so that the shank portion 34.1 is embedded in the mine sand and the eye portion 36.1 lies against the upper surface of the retaining cover panel 22.1.

After compaction of the mine sand in the pan 14.1, the shank portion 34.1 will be firmly located in the cell 10.1.

Thus when the cell 10.1 is to be conveyed, the eye portion 36.1 can be displaced away from the retaining cover panel 22.1 and used for suspending the cell 10.1.

The eye portion can conveniently be made out of a 16 gauge high tensile wire.

The cell 10.1 has a diameter of 400 mm and a height of about 75 mm. Each layer 12.1 will thus have a height of about 25 mm.

Thus the height to minimum lateral dimension ratio of the cell 10.1 is about 1:5 whereas the height to minimum lateral dimension ratio of each layer 12.1 is about 1:16.

To improve compaction of the mine sand in the cell 10.1, the mine sand was moistened with water prior to compaction, in a water to sand ratio of about 5% by volume.

The cell 10.1 was found to have a mass of about 20 kg which is low enough to allow ready handling of the cell 10.1.

It was further found that a number of corresponding cells 10.1 could be readily stacked upon each other to form a support pillar for use as a mine prop, and that the pillar had sufficient lateral stability even when thirteen cells had been stacked upon each other to form a pillar having a height of about 1 m.

To make the cell 10.1 more convenient for use as a mine prop, it can conveniently be formed with a height of 90 mm, so that each layer has a height of about 30 mm. Such a cell would have a mass of about 23 kg and can thus be conveniently be handled. Stacking of eleven such cells would give a support pillar having a height of approximately 1 m.

Figure 3:
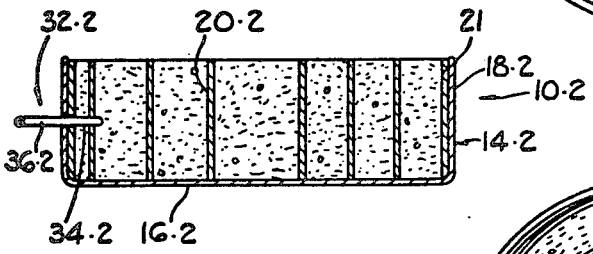
FIG. 3 shows a sectional side elevation along line III—III of FIG. 4, of an alternative embodiment of a displaceable load supporting cell.
Figure 4:
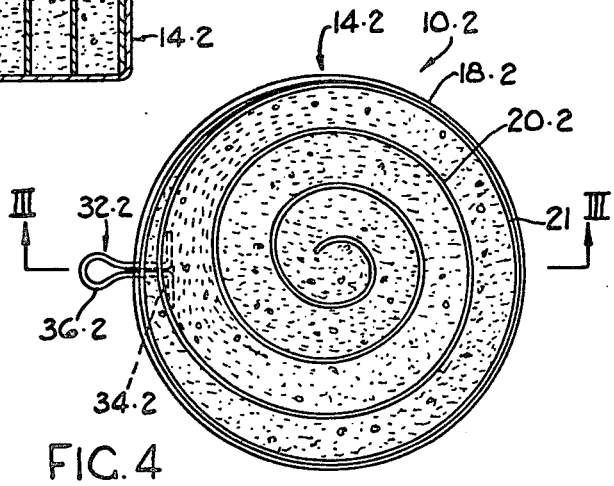
FIG. 4 shows a plan view of the cell of FIG. 3.

With reference to FIGS. 3 and 4 of the drawings, reference numeral 10.2 refers generally to an alternative embodiment of a displaceable load supporting cell in accordance with this invention.

Corresponding parts of the cell 10.2 which correspond with those of the cell 10.1 are indicated by corresponding reference numerals except that the suffix, "0.2" has been used in place of the suffix "0.1".

The cell 10.2 comprises a pan 14.2 which corresponds with the pan 14.1 of the cell 10.1.

The pan 14.2 thus has a base panel 16.2 and a retaining sleeve 18.2 which extends integrally from the base panel 16.2.

The pan 14.2 has been formed in the same way as the pan 14.1 out of 22 gauge mild steel sheet.

The cell 10.2 has restraining means differing from the restraining means of the cell 10.1.

The restraining means comprises a restraining spiral band 20.2 which is located within the pan 14.2 and has its outer loop 21 of circular section and secured to the retaining sleeve 18.2.

As in the case of the cell 10.1, the base panel 16.2 does, to a more limited extent, constitute a restraining panel to restrain lateral displacement of particulate material in the cell 10.2 under an applied load.

Further, as in the case of the cell 10.1, the cell 10.2 includes a suspension tab 32.2 comprising a shank portion 34.2 and an eye portion 36.2.

The suspension tab 32.2 has its shank portion 34.2 passed through suitable apertures in the sleeve 18.2 and the outer loops of the spiral band 20.2, and is firmly located in the cell 10.2 after compaction of the particulate material as will be hereinafter described.

In forming the cell 10.2, the pan 14.2 having the spiral band 20.2 located therein and having the suspension tab 32.2 located in position, is filled with a particulate material comprising mine sand having mixed therewith about 10% by volume of a bonding agent.

The bonding agent comprises a slurry sealed bituminous compound solution in the form of minute bituminous compound particles suspended in water. The solution comprises about 60% of bituminous compound and about 40% by volume of water.

The particulate material mixture is compacted in the pan 14.2 by applying a compaction pressure of about 8,000 to 12,000 kPa in a suitable press.

The pressure head of the press is faced with a resiliently compressible rubber pad.

The rubber pad thus accommodates uneveness which results in the particulate material during compaction and, after compaction, excess particulate material can be scraped off to level the upper surface of the cell 10.2.

Under the compaction pressure, the bituminous compound binds the mine sand particles so that the particles will be retained sufficiently in the cell 10.2 to allow handling thereof.

The retaining means of the cell 10.2 is thus provided by the bituminous compound incorporated in the mine sand, and by the retaining sleeve 18.2.

Experiments conducted by the applicant have shown that the cell 10.2 would tend to have a lower load bearing capacity than the cell 10.1, and would tend to have a marginally greater degree of compression than the cell 10.1.

However, the cell 10.2 would tend to be cheaper than the cell 10.1 and can therefore conveniently be used where a lower load bearing capacity is required.

Figure 5:
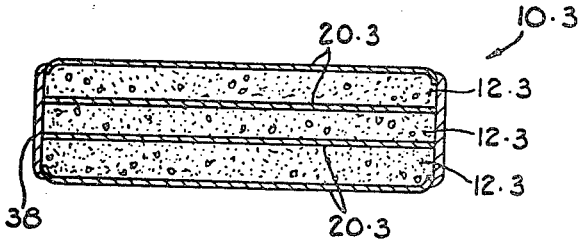
FIG. 5 shows a sectional side elevation of yet a further alternative embodiment of a load supporting cell in accordance with this invention.

With reference to FIG. 5 of the drawings, reference numeral 10.3 refers generally to yet a further alternative embodiment of a load supporting cell in accordance with this invention.

The cell 10.3 corresponds generally with the cell 10.1 and corresponding parts are therefore indicated by corresponding reference numerals except that the suffix "0.3" is used in place of the suffix "0.1".

The cell 10.3 comprises four restraining panels 20.3 and three compacted layers 12.3 of particulate material compacted under a compaction pressure of about 8,000 to 12,000 kPa.

The particulate material comprises mine sand having mixed therewith about 2% by volume of an adhesive in the form of a modified synthetic resin dispersion with a polyvinyl acetate base.

The cell 10.3 is formed by compaction in a suitable mould and, after compaction, the adhesive ensures that the compacted particulate material in the layers 12.3 is bonded together and bonded to the restraining panels 20.3.

After compaction, a coating of mine sand having about 20% by volume of the abovementioned adhesive mixed therein is applied as a coating 38 about the cylindrical periphery of the cell 10.3.

Once the coating 38 has set, it serves as retaining means for rotating the particulate material in the cell 10.3 during normal handling thereof.

To approve adhesion of the coating 38 to the outermost restraining panels 20.3, these two panels have their peripheral edges bent inwardly towards the interior of the cell 10.3 as can be seen in the drawing.

The cell 10.3 may include a suspension tab as hereinbefore described, conveniently associated with one of the inner restraining panels 20.3.

Figure 6:
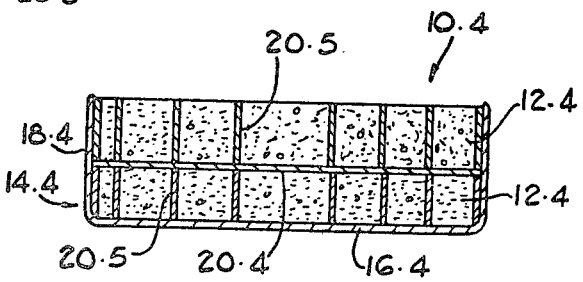
FIG. 6 shows a sectional side elevation of yet a further alternative embodiment of a load supporting cell in accordance with this invention.

With reference to FIG. 6 of the drawings, reference numeral 10.4 refers generally to yet a further embodiment of a load supporting cell in accordance with this invention.

The cell 10.4 corresponds generally with the cell 10.2, except that the particulate material is in two separate compacted layers 12.4, with the layers 12.4 separated by means of a restraining panel 20.4.

Each layer 12.4 has a spiral band 20.5 embedded therein.

Figure 7:
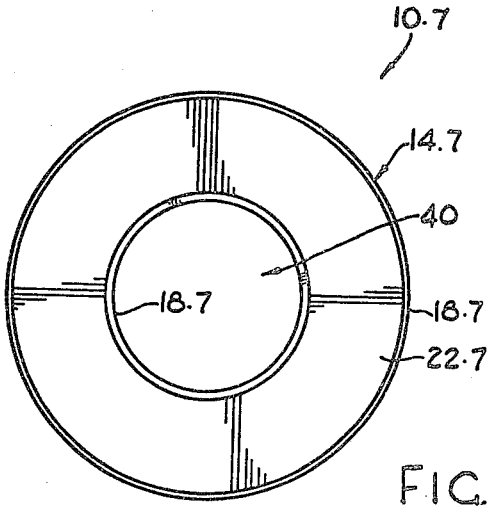
FIG. 7 shows a plan view of a further embodiment of a load supporting cell in accordance with this invention.
Figure 8:
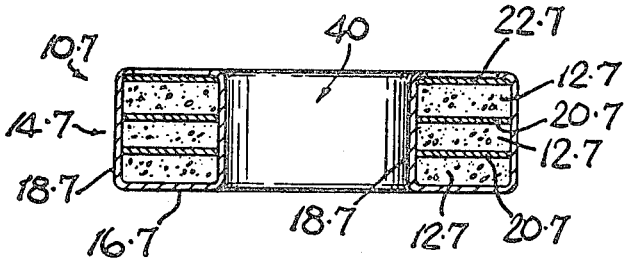
FIG. 8 shows a sectional side elevation of the cell of FIG. 7.

With reference to FIGS. 7 and 8 of the drawings, reference numeral 10.7 refers generally to yet a further alternative embodiment of a load supporting cell in accordance with this invention.

The cell 10.7 corresponds generally with the cell 10.1, except that it is of annular configuration in plan view and thus has a hollow central core 40.

The cell 10.7 thus has an annular pan 14.7 comprising an annular base panel 16.7 and annular retaining sleeves 18.7.

The cell 10.7 has annular restraining panels 20.7, an annular retaining cover panel 22.7, and three annular compacted layers of mine sand 12.7.

The cell 10.7 has the load supporting portions thereof arranged in an annular band so that the lateral stability of the cell is improved without unduly increasing the cost or mass of the cell 10.7.

It will be appreciated that as hereinbefore described with reference to FIGS. 3 and 4 of the drawings, in place of the restraining panels 20.7, a spiral band can be provided within the annular pan 14.7.

With reference to FIG. 9 of the drawings, reference numeral 42 refers generally to a support pillar in the form of a mine prop.

The support pillar 42 is shown resting on a foot wall 44 in a mine for supporting the hanging wall 46.

The support pillar 42 has been formed by stacking eleven cells 10.9 on top of each other.

Each cell 10.9 corresponds with the cell 10.1 as illustrated in FIGS. 1 and 2 of the drawings, except that each cell 10.9 has a diameter of 390 mm, a height of 90 mm, and contains three compacted discrete layers of mine sand, each having a height of about 30 mm.

The pillar 42 thus has a height of about 1 m.

To allow for adjustment of the height of the pillar 42 to fit relatively snugly between the hanging wall 46 and the foot wall 44, a filler cell 10.10 has been stacked on top of the pillar 42.

The filler cell 10.10 comprises a pan 14.9 containing a single compacted layer of particulate material.

The particulate material is either in the form of mine sand which includes a bonding agent to retain the particulate material in the pan 14.9, or a retaining panel or sheet is located thereon to retain the mine sand in the pan 14.9.

Conveniently, filler cells having a suitable range of heights can be provided. Thus a filler cell having an appropriate height can be selected for filling the gap between the upper surface of an erected pillar and the hanging wall 46.

If the gap is not large enough to admit a further cell 10.9, several filler cells of suitable heights can be stacked on top of each other to fill the gap.

If desired, purely to hold the pillar 42 stable until the hanging wall has sagged onto it, wedging or the like may be applied to the pillar 42.

It is an advantage of the embodiments of the invention as illustrated in the drawings, that load supporting cells are provided which can readily be handled and can readily be stacked for use.

It is a further advantage that the degree of compression under load, and the load bearing capacities of the cells can be adjusted within reasonable limits by varying the compaction pressure applied to compact the particulate material by varying the tensile strength, form and number of the restraining, by varying the type and composition of the particulate material, and by varying the height to lateral dimension ratios of the cells.

It is a further advantage of the embodiments of the invention as illustrated in the drawings, that the main function of the retaining means is to retain the particulate material in position in the layers during handling, and that reliance is placed on the angle of repose of the compacted particulate material and the restraining effect to lateral displacement of the particulate material provided by the restraining means to provide the load bearing capacity and the resistance to compression under load. Thus, once the cells are in a loaded condition during use, the contribution of the retaining sleeves will tend to be neglible and the load bearing capacity of the cells will not be affected unduly by corrosion or damage to the retaining sleeves.

With reference to FIG. 10 of the drawings, the curves plotted on the graph shown the results obtained when two pillars formed out of stacked cells in accordance with this invention were tested in a press having a maximum capacity of 940 tons.

The results obtained for the first pillar are indicated by the solid line, and the results obtained for the second pillar are indicated by the chain dotted line.

For the first pillar, thirteen cells were used corresponding exactly with the cells 10.1 as illustrated in FIGS. 1 and 2 of the drawings.

These cells were stacked to provide an original pillar height of 974 mm.

The mine sand in each cell was compacted under a compaction pressure of 12,000 kPa.

For he second pillar thirteen cells were used corresponding substantially with the cell 10.1 of FIGS. 1 and 2, except that each cell included seven restraining panels 20.1 in place of the two restraining panels of the cell 10.1.

Each cell had a height slightly above 70 mm, giving an original pillar height of 940 mm.

In forming the cells, the mine sand was compacted under a compaction pressure of 20,000 kPa.

It will be noted from the solid line curve that the first pillar failed once the load had reached a value of 795 tons. At this state the compression of the first pillar was about 32%.

Upon failure of the first pillar, the compression increased slightly more, but the first pillar retained a residual load bearing capacity in excess of 200 tons (this not being reflected on the graph).

From further tests conducted on a corresponding pillar to the first pillar, applicant found that if the load is applied more slowly, the degree of compression is reduced substantially.

In the case of the test of which the results are reflected by the solid line in the graph, the load was applied over a period of approximately ten minutes.

In other similar experiments conducted by the applicant, it was found that with an applied load of 500 tons, the degree of compression amounted to only 11 to 12%.

In the case of the second pillar, the second pillar showed no signs of failure when the maximum of the press, that is 940 tons, had been reached.

At this maximum loading, the compression amounted to less than 18%. At a loading of 500 tons, the compression amounted to less than 7%.

The results obtained as represented in the graphs, not only give an indication of the loading bearing capacity of some pillars constructed in accordance with this invention, but indicate how the load bearing capacity and degree of compression can readily be varied by varying the number of restraining panels employed and thus the heights of the compacted layers of mine sand.

I claim:

1. A displaceable load supporting cell for supporting a load pressure of at least about 8,000 kPa with a compression of less than about 20%, and comprising at least one compacted layer of particulate material compacted under a pressure of at least about 12,000 kPa and having a height which is less than about one third of its minimum lateral dimension, retaining means for retaining the particulate material particles against dislodgement from the layer, and restraining means comprising at least one radially expansible restraining panel which is associated with the layer to extend transversely to the height of the layer, the restraining panel having a sufficient tensile strength to resist fracture during radial expansion under applied load pressures for which the cell is designed, the particulate material particles being such that while they are capable of being displaced relatively to each other under an applied load during compression of the cell, they co-operate frictionally with each other and with the restraining panel to restrain lateral displacement of the particles in the layer under an applied load.

2. A cell according to claim 1, in which the restraining means has a sufficient tensile strength for the cell to be capable of supporting a pressure of at least about 16,000 kPa with a compression of less than about 20%.

3. A cell according to claim 1 in which the ratio of the height of the layer to its minimum lateral dimension is between about 1:5 and about 1:10.

4. A cell according to claim 3 including a plurality of stacked, compacted layers of particulate material and a plurality of restraining panels which are positioned between adjacent layers.

5. A support pillar for supporting a load, and comprising a plurality of load supporting cells as claimed in claim 3 stacked upon each other.

6. A cell according to claim 3, in which the restraining means has a sufficient tensile strength for the cell to be capable of supporting a pressure in excess of about 24,000 kPa with a compression of less than about 20%.

7. A cell according to claim 3, in which the particulate material includes moisture to improve compaction thereof.

8. A cell according to claim 7, in which the moisture content is between about 3% and about 8% by volume.

9. A cell according to claim 1, in which the compacted layer is a layer compacted under a pressure of between about 12,000 and about 25,000 kPa.

10. A cell according to claim 9, in which the ratio of the height of the layer to its minimum lateral dimension is between about 1:15 and about 1:40.

11. A cell according to claim 10, in which the retaining means comprises an adhesive coating layer applied to peripheral zones of the particulate material layer.

12. A cell according to claim 1, in which the retaining means comprises a retaining sleeve about the lateral periphery of the layer.

13. A cell according to claim 12 including suspension tab means for use in suspending the cell during handling thereof.

14. A cell according to claim 12, in which the restraining means comprises at least one restraining panel which is positioned to constitute an end wall of the cell, and which is secured to the retaining sleeve.

15. A cell according to claim 14, in which the restraining means includes at least two restraining panels which are positioned to constitute opposed end walls of the cell.

16. A cell according to claim 1, in which the retaining means comprises a bonding agent mixed with the particulate material to bond the particles together, the bonding effect being insufficient to restrain relative displacement of the particles during compression of the layer.

17. A cell according to claim 16, in which the bonding agent comprises a cold setting adhesive.

18. A cell according to claim 17, in which the proportion by volume of bonding agent to particulate material is between about 2% and about 10%.

19. A cell according to claim 16, in which the bonding agent comprises a bituminous compound solution.

20. A cell according to claim 19, in which the bonding agent comprises a slurry sealed bituminous compound suspended in water.

21. A cell according to claim 20, in which the proportion by volume of bonding agent to particulate material is between about 5% and about 20%.

22. A support pillar for supporting a load pressure of at least about 8,000 kPa with a compression of less than about 20%, and comprising a stack of layers of particulate material compacted under a pressure of at least about 12,000 kPa, each layer having restraining means in the form of a radially expansible restraining panel which extends transversely to the height of the pillar associated therewith, each restraining panel having a sufficient tensile strength to resist fracture during radial expansion under applied load pressure for which the pillar is designed, the particulate material particles of each layer being such that while they are capable of being displaced relatively to each other under an applied load during compression of the pillar, they cooperate frictionally with each other and with their restraining panels to restrain lateral displacement of the particles in the layer under an applied load, and each layer having a height less than about one third of its minimum lateral dimension.

23. A support pillar according to claim 22, in which the restraining panel of each layer separates that layer from an adjacent layer.

24. A support pillar according to claim 22, in which the layers are compacted under a pressure of between about 12,000 and about 25,000 kPa.

25. A support pillar according to claim 22, in which the ratio of the height of each layer to its minimum lateral dimension is between about 1:10 and about 1:20.

26. A method of forming a load supporting cell for supporting a load pressure of at least about 8,000 kPa with a compression of less than about 20%, which includes the steps of filling a pan having a height less than about one third of its minimum lateral dimension and comprising a base panel and a retaining sleeve extending upwardly from the periphery of the base panel, with particulate material, positioning the pan in a die shaped to restrain lateral expansion of the pan, and applying a pressure of at least about 12,000 kPa to the particulate material to compact it into a layer in the pan, the base panel being radially expansible and having a sufficient tensile strength to resist fracture during radial expansion under applied load pressures for which the cell is designed, and the particulate material particles being such that while they are capable of being displaced relatively to each other under an applied load during compression of the cell, they co-operate frictionally with each other and with the base panel to restrain lateral displacement of the particles in the layer under an applied load.

27. A method according to claim 26, which includes the step of locating restraining means in the pan to restrain lateral displacement of the particulate material under load, the restraining means comprising at least one radially expansible restraining panel embedded in the particulate material to divide the compacted particulate material into stacked layers.

28. A method according to claim 26, in which a pressure of between about 12,000 and about 25,000 kPa is applied to compact the particulate material.

29. A method according to claim 26, in which the ratio of the height of the pan to its minimum lateral dimension is less than about 1:5.

30. A method according to claim 26, which includes the step of moistening the particulate material to improve compaction thereof.

31. A load supporting cell whenever formed by the method as claimed in claim 26.

32. A method according to claim 26, which includes the step of providing retaining means for retaining the particulate material when compacted in the pan.

33. A method according to claim 32, in which the retaining means is provided by a bonding agent mixed with the particulate material prior to compaction.

34. A method according to claim 32, in which the retaining means is provided by locating a cover panel or pan on the particulate material prior to compaction, and in which the cover panel or pan is secured to the retaining sleeve after compaction.

* * * * *